US007293385B2

(12) United States Patent
McCormick

(10) Patent No.: US 7,293,385 B2
(45) Date of Patent: Nov. 13, 2007

(54) MODULAR TRIGGER GROUP FOR FIREARMS AND FIREARM HAVING A MODULAR TRIGGER GROUP

(76) Inventor: Michael L. McCormick, 6002 Hudson Bend Rd., Austin, TX (US) 78734

( * ) Notice: Subject to any disclaimer, the term of this patent is extended or adjusted under 35 U.S.C. 154(b) by 0 days.

(21) Appl. No.: 11/621,485

(22) Filed: Jan. 9, 2007

(65) Prior Publication Data

US 2007/0151138 A1 Jul. 5, 2007

Related U.S. Application Data

(60) Division of application No. 10/806,300, filed on Mar. 22, 2004, now Pat. No. 7,162,824, which is a continuation of application No. 10/152,557, filed on May 21, 2002, now Pat. No. 6,772,072.

(51) Int. Cl.
*F41A 11/00* (2006.01)

(52) U.S. Cl. ..... 42/75.03; 42/41; 42/42.02; 42/42.03; 42/69.03; 89/128; 89/138; 89/155; 89/27.11; 124/31; 124/32

(58) Field of Classification Search ..... 42/75.03, 42/75.01, 69.01; 89/27.11; 124/31, 32
See application file for complete search history.

(56) References Cited

U.S. PATENT DOCUMENTS 3,323,246 A 6/1967 Loffler
3,766,677 A 10/1973 Waddell
3,785,243 A 1/1974 Christakos
3,863,375 A 2/1975 Browning
3,924,512 A 12/1975 Fagg
4,056,038 A 11/1977 Rath
4,151,670 A 5/1979 Rath
4,310,981 A 1/1982 Waddell
4,463,654 A 8/1984 Barnes et al.
4,662,098 A 5/1987 Timari (Continued)

OTHER PUBLICATIONS

Murtz, "The Gun Digest of Exploded Gun Drawings." 2005, KP Books, pp. 620, 625, and 658.

*Primary Examiner*—Michael J. Carone
*Assistant Examiner*—Stewart T Knox
(74) *Attorney, Agent, or Firm*—Russell D. Culbertson; The Culbertson Group, P.C.

(57) ABSTRACT

A module housing is adapted to be inserted into an operating position in the trigger group receiving area of a firearm. The module housing includes at least one pin receiver defined by two openings formed in the module housing, one on each lateral side of the housing. A module pin is received in the pin receiver and at least one trigger group component is mounted or supported for rotation on the module pin. The pin receiver is located on the module housing so as to align with a pin receptacle of the firearm when the module housing is in the operating position. By locating the pin receiver in the module housing so as to align with a corresponding pin receptacle of the firearm when the module housing is in the operating position, the trigger group module and the trigger group components housed in the module housing may be readily supported by the OEM pin receptacle. The trigger group module, pre-assembled with one or more trigger group components, may be inserted to the operating position and then held in place using the OEM pin receptacle.

10 Claims, 5 Drawing Sheets

U.S. PATENT DOCUMENTS

| | | | | |
|---|---|---|---|---|
| 4,709,617 | A | | 12/1987 | Anderson |
| 4,872,391 | A | | 10/1989 | Stoner |
| 4,942,802 | A | | 7/1990 | Stoner |
| 4,972,617 | A | | 11/1990 | Major |
| 5,038,666 | A | | 8/1991 | Major |
| 5,052,141 | A | | 10/1991 | Sammons |
| 5,454,182 | A | | 10/1995 | Lewis et al. |
| 5,487,233 | A | | 1/1996 | Jewell |
| 5,501,134 | A | | 3/1996 | Milazzo et al. |
| 5,614,691 | A | | 3/1997 | Taylor |
| 5,659,992 | A | | 8/1997 | Mistretta |
| 5,680,722 | A | | 10/1997 | French et al. |
| 5,697,178 | A | | 12/1997 | Haskell |
| 5,881,485 | A | | 3/1999 | Milazzo |
| 5,904,132 | A | * | 5/1999 | Biller ..... 124/22 |
| 6,131,324 | A | | 10/2000 | Jewell |
| 6,293,040 | B1 | | 9/2001 | Luth |
| 6,347,569 | B1 | | 2/2002 | Butler |
| 6,487,806 | B2 | | 12/2002 | Murello et al. |

* cited by examiner

MODULAR TRIGGER GROUP FOR FIREARMS AND FIREARM HAVING A MODULAR TRIGGER GROUP

CROSS-REFERENCE TO RELATED APPLICATIONS

This application is a divisional of U.S. patent application Ser. No. 10/806,300, filed Mar. 22, 2004, and entitled "Modular Trigger Group for Firearms and Trigger Group Installation Method," now U.S. Pat. No. 7,162,824 B1, which is a continuation of U.S. patent application Ser. No. 10/152,557, filed May 21, 2002, and entitled "Trigger Group Module for Firearms and Method for Installing a Trigger Group in a Firearm," now U.S. Pat. No. 6,722,072 B1. The Applicant hereby claims the benefit of both of these prior applications under 35 U.S.C. §120. The entire content of each of these prior applications is incorporated herein by this reference.

TECHNICAL FIELD OF THE INVENTION

The invention relates to firing mechanisms for firearms. More particularly, the invention relates to a trigger group module pre-assembled with one or more trigger group components and adapted to be received in the frame of the firearm. The invention also relates to a method of installing trigger group components in a firearm.

BACKGROUND OF THE INVENTION

Firearm firing mechanisms generally include a number of components that cooperate to hold a spring-loaded hammer in a cocked position and then selectively release the hammer. The firearm is fired or discharged when the force of the released hammer is applied, directly or through an intermediate device, to an ammunition cartridge loaded in the firearm. The components for holding the hammer in a cocked position and then releasing the hammer as desired may be referred to as a trigger group. In addition to the hammer itself, a trigger group generally includes a trigger component having a finger lever or trigger that a user pulls to release the hammer, and further includes a sear which may be a separate component or integrally formed with the trigger component. Some trigger groups also include other components such as a disconnector for example. The disconnector is used in semi-automatic firearms to catch the hammer as it rebounds after firing and to hold the hammer in a cocked position until the shooter can release the trigger and thereby reset the trigger group to the "ready to fire position." The disconnector is required for this function because semi-automatic firearms usually cycle so quickly that it is physically impossible for the shooter to release the trigger quickly enough after a discharge to allow the sear to recapture the hammer in the cocked position.

Both the hammer component and trigger component are commonly mounted for rotation in the firearm. The hammer is mounted on a hammer pin to facilitate the desired rotation, while the trigger component is mounted on a trigger pin. Each pin is retained in a respective pin receptacle formed in the firearm. Each such pin receptacle is defined by a first opening on one side of the firearm and a second opening on the opposite side of the firearm. A hammer spring is included in the trigger group to, among other things, bias the hammer forward to a striking position. The trigger component is also spring biased to provide resistance against pulling the trigger and to return the trigger after it has been pulled.

It may be desirable to modify or replace trigger group components in a firearm. This is particularly true for firearms used in competition. Such competition firearms may be fitted with special trigger group components designed to improve firearm performance or operational characteristics, or to suit the preferences of the particular user. Also, different competitions or firearm applications may require different trigger group characteristics. However, due to the relatively small components in the trigger group, the spring loading of components, the close tolerances between components, and the small area in the firearm allotted for trigger group components, a trigger group may commonly be installed only by a skilled gunsmith using specialized tools in order to ensure safe, proper, and reliable trigger group functioning. Due to the difficulty in changing out trigger group components, it is common for many competition shooters to have several different complete firearms each with a different trigger group setup for a particular competition or portion of a competition. Maintaining several complete firearms greatly increases the cost of competitive shooting.

Some prior art original equipment manufacturer (OEM) firearm designs include a detachable housing that houses trigger group components. The housing may be attached to the firearm frame with screws or with pins that extend transversely through the housing and are supported at either end by receptacles or bearing openings in the firearm frame. These prior art OEM trigger group housings attach from the bottom of the firearm and include a trigger guard and surfaces that actually form part of the exterior of the fully assembled firearm. Prior art OEM trigger group housings also house safety components that cooperate with the trigger group components. These structures and surfaces associated with the prior art OEM trigger group housings limit their use to firearms specifically designed for such housings.

SUMMARY OF THE INVENTION

The present invention provides a trigger group module that is pre-assembled with the trigger group components and adapted to be mounted in a trigger group receiving area in place of the OEM trigger group. The invention includes a special module housing and also includes the special housing pre-assembled with one or more trigger group components to form the self-contained trigger group module. The invention further includes methods for mounting or installing a trigger group in a firearm.

A module housing according to the invention is adapted to be inserted into an operating position in the trigger group receiving area of a firearm. The module housing includes at least one pin receiver defined by two openings formed in the module housing, one on each lateral side of the housing. In one form of the invention a module pin is received in the pin receiver and at least one trigger group component is mounted or supported for rotation on the module pin. In this form of the invention, the module pin includes a pin receiving opening there through and is located on the module housing so that this pin receiving opening aligns with a pin receptacle of the firearm when the module housing is in the operating position. That is, the two openings defining the pin receiver on the module housing and the pin receiving opening through the module pin are adapted to align with the openings on the firearm that define a pin receptacle for the firearm.

By locating the pin receiver in the module housing so as to align with a corresponding pin receptacle of the firearm when the module housing is in the operating position and by providing a pin receiving opening in the module pin, the trigger group module and the trigger group components housed in the module housing may be readily supported by the OEM pin receptacle. The trigger group module, pre-assembled with one or more trigger group components, may be inserted to the operating position and then a pin may be inserted or extended through the OEM pin receptacle and aligned trigger group component and module pin to support the trigger group component in the desired functional position in the firearm. The module housing and module pin hold the trigger group component in place while the module housing is being placed in the firearm. No modification to the frame of the firearm is required and no special skill or tools are required to install the self-contained, pre-assembled trigger group module.

One preferred form of the invention is adapted to be used with a firearm that includes a hammer pin receptacle and a trigger pin receptacle. The trigger group module for this firearm includes a first pin receiver and a second pin receiver. The first pin receiver aligns with the hammer pin receptacle of the firearm when the housing is in the operating position and the second pin receiver aligns with the trigger pin receptacle when the housing is in the operating position. The first pin receiver is adapted to receive a first module pin having a pin receiving opening there through and the second pin receiver is adapted to receive a second module pin having a separate pin receiving opening there through. To install this trigger group module, the original trigger group components are removed from the firearm together with any interfering components such as safety mechanisms for example, and then the pre-assembled trigger group module is placed in the operating position in the firearm. Once in the operating position, the trigger group module may be held in place by pins inserted through the openings defining the hammer pin receptacle and trigger pin receptacle, respectively. Alternatively, caps, screws, or other elements may be inserted into the OEM pin receptacle openings to cooperate with a trigger group module or module pin to retain the trigger group module in the operating position.

In yet other forms of the invention, the module housing may include no pin receiver openings located to align with OEM pin receptacle openings when the trigger group module is in the operating position in the firearm frame. Rather, the trigger group component geometry may be completely changed from the OEM trigger group geometry. In these forms of the invention, the OEM pin receptacle openings may still be used to receive screws, pins, or other devices to secure the trigger group module in the operating position in the firearm frame.

A module housing according to the invention may also include a trigger component control feature that defines or sets either the forward most or rearward most position of the trigger component. Two different trigger component control features may be used to set both the forward most and rearward most position of the trigger component. The trigger component control feature setting the rearward most position of the trigger component provides overtravel control to minimize the amount of trigger movement possible after the hammer release point. The trigger component control feature setting the forward most position of the trigger component provides take-up control which minimizes the movement of the trigger required before reaching the hammer release point. A major advantage of the present invention is that by incorporating the overtravel and take-up features in the module housing, trigger overtravel and take-up may be modified without having to modify the frame of the firearm itself.

These and other features and advantages of the invention will be apparent from the following description of the preferred embodiments, considered along with the accompanying drawings.

DESCRIPTION OF PREFERRED EMBODIMENTS

Figure 1A:
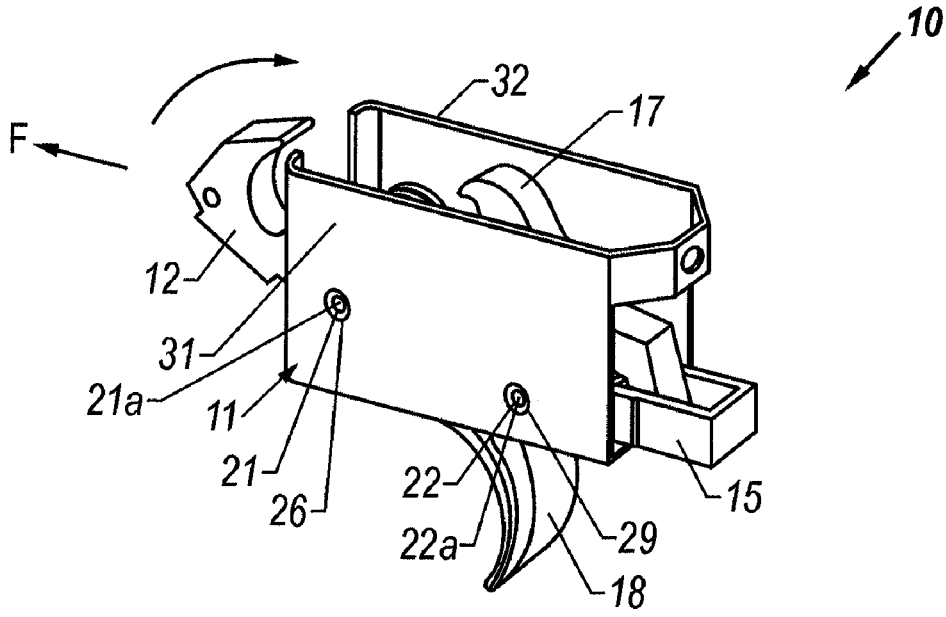
FIG. 1A is a view in perspective of a trigger group module embodying the principles of the invention.
Figure 1B:
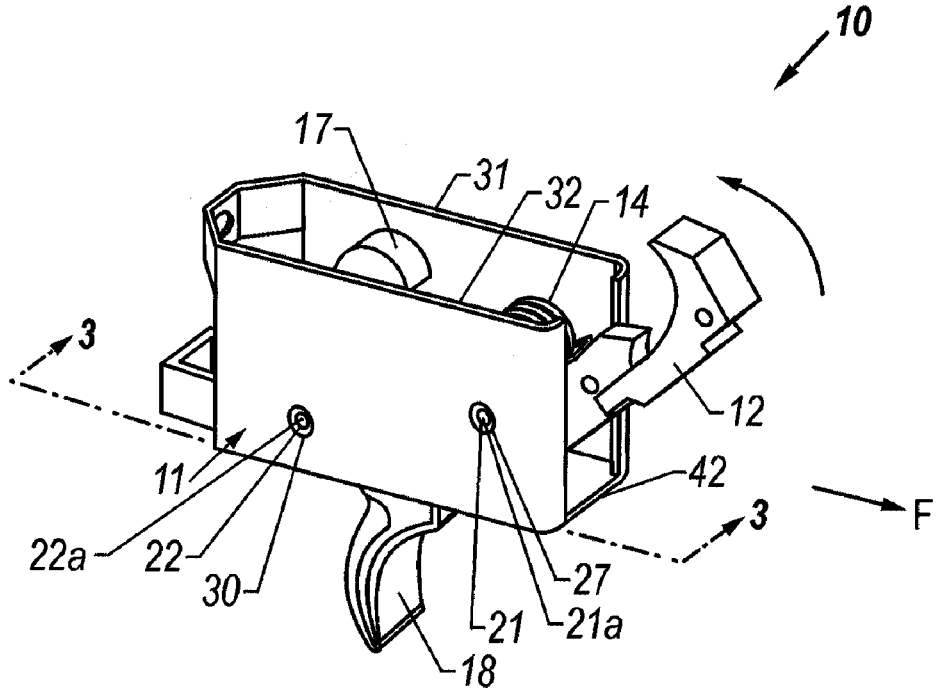
FIG. 1B is a view of the trigger group module shown in FIG. 1A from an opposite perspective to that shown in FIG. 1A.

A trigger group module 10 and module housing 11 embodying the principles of the invention may be described with reference to FIGS. 1A and 1B through FIG. 3. A method embodying the principles of the invention for installing a trigger group may be described with reference to FIGS. 4 through 8.

In the following description and claims, certain elements may be described as right side elements while others may be described as left side elements. The terms right side and left side are used only for purposes of convenience to indicate that a particular element is located on one lateral side of the respective structure while another element is located on the opposite lateral side of the structure. Of course, whether an element is truly located on a right side or left side depends upon the perspective of the viewer. For purposes of consistency, the right side elements described below will be those elements located on the right side of trigger group module 10 as viewed from the front of the module with the trigger extending downwardly, while the left side elements will be those elements on the left side as viewed from the front of the module. The direction from the rear to the front of the module will be indicated by the arrow F in each figure showing the module 10.

Referring first to FIGS. 1A and 1B through FIG. 3, trigger group module 10 includes module housing or housing 11 for containing one or more trigger group components. The trigger group components shown for purposes of example are shown best in FIGS. 2 and 3 and include a hammer 12, hammer spring 14, a trigger component 15 having a trigger or finger lever 18, a trigger spring 16, and a disconnector 17. It will be appreciated by those skilled in the art that disconnector 17 is associated with a disconnector spring, however, the disconnector spring is not necessary or helpful in describing the invention and is thus omitted from the drawings. The illustrated trigger group components are held in place in the module housing with module pins and specifically a first module pin 21 for hammer 12 and a second module pin 22 for trigger component 15. Each of the illustrated module pins 21 and 22 include an opening 21*a* and 22*a*, respectively, extending there through. First module pin 21 is received through a pin opening 23 of the hammer while second module pin 22 is received through a pin opening 24 of trigger component 15 and a pin opening (not shown) of disconnector 17.

Housing 11 includes a first pin receiver for receiving first module pin 21 and supporting the first module pin by its ends. This first pin receiver is made up of a first right side receiver opening 26 on a right lateral side or first side wall 31 of housing 11 and a first left side receiver opening 27 on the opposite lateral side or second side wall 32 of the housing. Similarly, housing 11 includes a second pin receiver for receiving second module pin 22 and supporting the second module pin by its ends. This second pin receiver is made up of a second right side receiver opening 29 and a second left side receiver opening 30. Module pins 21 and 22 may be held in place in module housing 11 by frictional engagement with the receiver openings, by "C" retainers, or by any other suitable means.

Those familiar with different types of firearms will recognize that the trigger group components shown for purposes of example in the embodiment of the invention shown in FIGS. 1A and 1B through FIG. 3 are the components used in the firing mechanism for the COLT model AR-15 rifle. However, these trigger group components are shown only for purposes of example and there are many other types and arrangements of trigger group components that may be included in a trigger group module embodying the principles of the present invention. The invention is in no way limited to the trigger group arrangement for an AR-15 rifle or the trigger group components shown in the figures. In particular, some trigger components are designed to slide along a track rather than pivot on a pin. Trigger groups having a sliding trigger component may include only a pin for the hammer.

Figure 3:
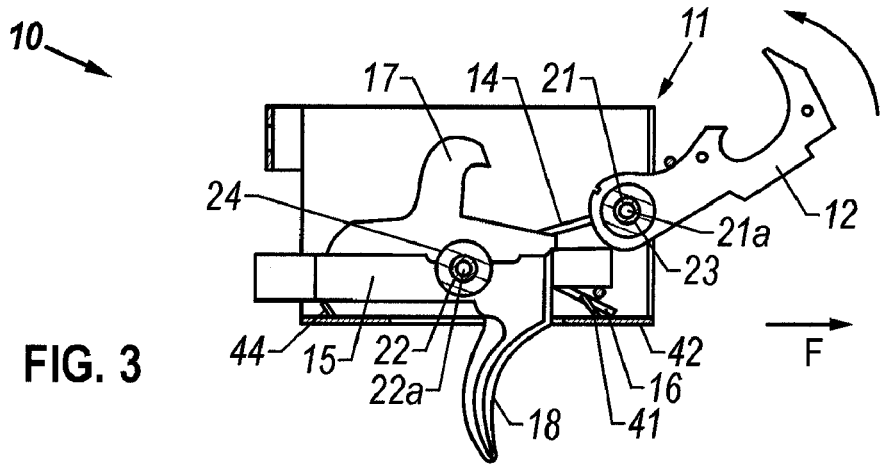
FIG. 3 is a view in section taken a long line 3-3 in FIG. 1B.

As shown best in FIG. 3, the trigger group module 10 according to the invention may include an overtravel feature 41. Overtravel feature extends from a bottom wall 42 of housing 11 in a forward or front portion of the housing in position to contact a forward part of trigger component 15 so that the component cannot rotate further forwardly or clockwise in FIG. 3. This effectively defines the rearward most position of trigger 18. As is known in the art, overtravel control prevents the trigger from excessive rearward movement after the hammer release point.

The illustrated module 10 also includes a take-up feature 44. Take-up feature 44 extends from housing bottom wall 42 in a rear portion of housing 11 in position to contact a rear part of trigger component 15. Contact between take-up feature 44 and trigger component 15 prevents the trigger component from rotating further counterclockwise in FIG. 3, and thus the take-up feature effectively defines the forward most position of trigger 18. As is known in the art, take-up control minimizes the amount of trigger movement or "take-up" before reaching the hammer release point.

Both overtravel feature 41 and take-up feature 44 represent trigger component control features that define the limits of movement of the trigger component. In the preferred embodiment of the invention where housing 11 is formed from sheet metal, both features may be formed by pressing out a portion of the bottom wall of the housing using a suitable stamp or press. The illustrated overtravel and take-up features are stamped to form an elongated member that is unsupported at one end. These elongated members may be bent upward or downward to adjust the overtravel and take-up. Set screws or other adjustable arrangements in housing 11 may also be used to form adjustable overtravel and take-up features within the scope of the present invention. It will be appreciated, however, that the invention is not limited to modules including trigger component control features of any type.

The method of installing a trigger group in a firearm may be described with reference to FIGS. 4 through 8. The method includes inserting trigger group module 10 into a trigger group receiving area of a firearm receiver or frame 50. The trigger group receiving area in the illustrated firearm frame 50 is shown generally at reference numeral 51 (distinguishable only in FIG. 6) and comprises a cavity defined between lateral side walls 53 and 54 of firearm frame 50 large enough to house all of the trigger group components and allow each of the components to move as desired to perform their respective function. As mentioned previously, the model AR-15 rifle is used as a convenient and familiar example in this disclosure. In the AR-15 example, trigger group receiving area 51 is accessible through a top opening that is exposed by removing a top component of the firearm referred to as the upper receiver (52 in FIG. 5). Firearm frame 50 comprises the portion of the model AR-15 rifle known as the lower receiver and is shown in the figures with upper receiver 52 removed to expose the top opening to trigger group receiving area 51. Upper receiver 52 may be reattached to the lower receiver or frame 50 after trigger group module 10 is installed as described in detail below.

The OEM trigger group for the AR-15 model rifle includes the hammer, trigger component, disconnector, and associated springs similar to that shown in connection with module 10. In order to support the OEM trigger group components in the trigger group receiving area 51, firearm frame 50 includes a first pin receptacle for receiving and supporting a first OEM trigger group pin and a second pin receptacle for receiving and supporting a second OEM trigger group pin. In this case, the first pin receptacle comprises a hammer pin receptacle made up of a right side receptacle opening 57 and a left side receptacle opening 58 (retaining the definition of right and left as described above and using arrow F to indicate the front of the devices in FIGS. 6 through 8). The second pin receptacle comprises a trigger component receptacle made up of a right side receptacle opening 59 and a left side receptacle opening 60. Openings 57 and 59 are formed through the right lateral side wall 53, while openings 58 and 60 are formed through the left lateral side wall 54. Each of these openings 57, 58, 59, and 60 provide bearing surfaces for supporting a respective OEM trigger group pin extending through frame 50 between right lateral side wall 53 and left lateral side wall 54. The OEM pins are not shown in the figures, however, it will be appreciated that the pins fit into the respective pair of pin openings 57 and 58 or 59 and 60, and through the pin receiving opening of the respective trigger group component or components. The OEM hammer and trigger pins for the model AR-15 rifle each include an indent in a mid-section of the pin which cooperates with a part of the trigger group serving as a detent to hold the pin in place. In the installed position, the OEM trigger group pins support the hammer, trigger component, and disconnector in their respective operational positions and allow the components to pivot as desired according to the operation of the trigger group.

It will be appreciated that the trigger group receiving area of a firearm is a relatively small area, commonly less than two inches wide. Considering the small area in which to work, the small components that fit in the area, the close tolerances between components, and the spring loading of the components, it is no easy matter to position the trigger group components in the trigger group receiving area of a firearm and hold the components in the proper position under spring pressure and aligned with the pin receptacle openings while pressing the pins in place. This trigger group installation according to the prior art method generally requires special tools, skills, and experience. The prior art trigger group installation method also requires great hand strength to hold the various components in position against the pressure of the springs in the trigger group.

Figure 4:
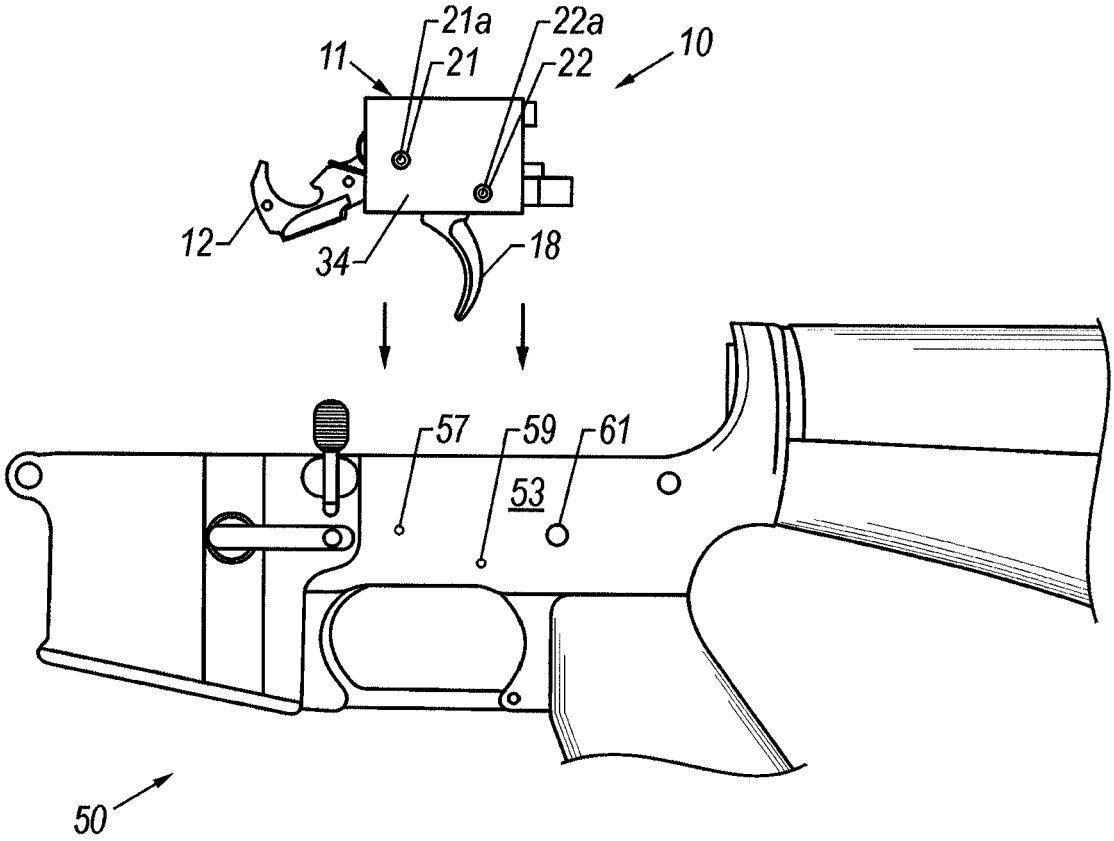
FIG. 4 is a side view showing a portion of a firearm with a trigger group module embodying the principles of the invention in position to be inserted to an operating position in the firearm.
Figure 5:
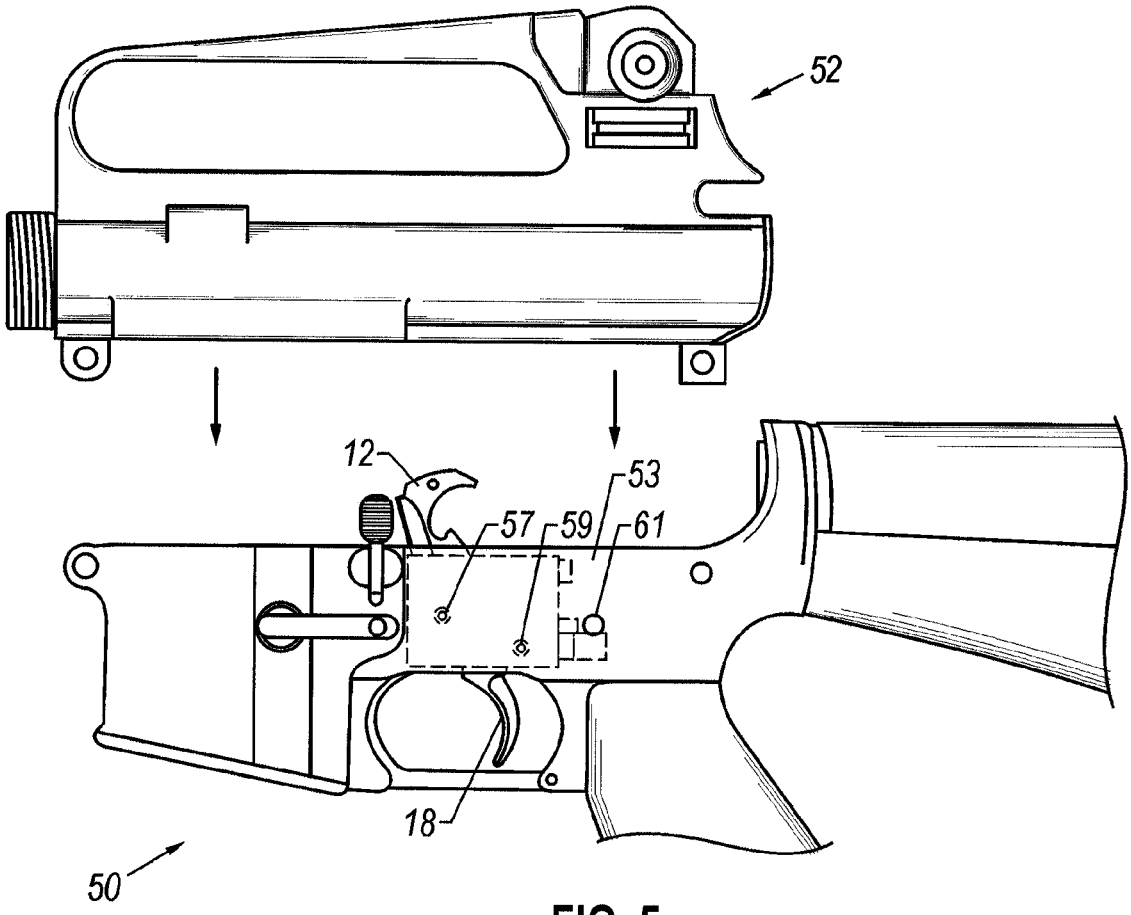
FIG. 5 is a side view similar to FIG. 4, but showing the trigger group module inserted to the operating position and showing an upper receiver in position to be connected over the trigger group module in the lower portion of the firearm.
Figure 6:
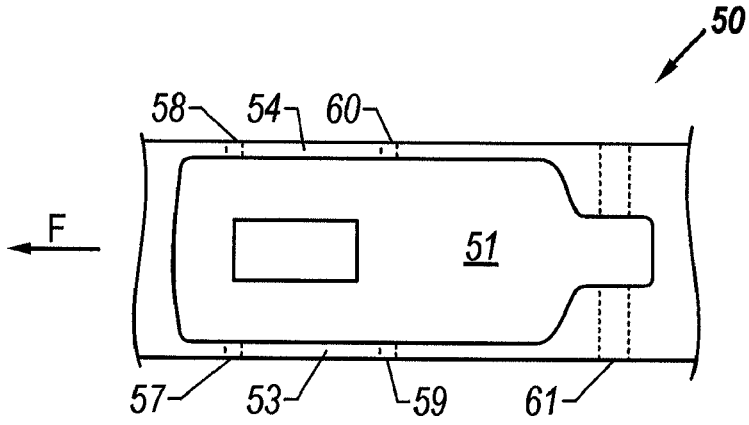
FIG. 6 is an enlarged top view of the trigger group receiving area of the firearm shown in FIGS. 4 and 5.

Trigger group installation according to the present invention using trigger group module 10 greatly simplifies installation, and may allow a new trigger group to be installed without special tools and skills. After the previous or OEM trigger group components are removed to place the firearm frame in the condition shown in FIG. 6, the present trigger group installation method includes first inserting the self-contained, pre-assembled trigger group module 10 into an operating position in firearm trigger group receiving area 51. In this operating position, at least one pin receiver on module housing 11 is aligned with a corresponding pin receptacle of the firearm. In the illustrated case, the first pin receiver is positioned with its defining openings 26 and 27 aligned with the firearm pin receptacle defined by receptacle openings 57 and 58. This alignment of openings 26 and 27 with receptacle openings 57 and 58 also aligns module pin opening 21*a* with these receptacle openings. The illustrated case also requires positioning module housing 11 with the pin receiver openings 29 and 30 aligned with firearm pin receptacle openings 59 and 60. This alignment of openings 29 and 30 with pin receptacle openings 59 and 60 also aligns module pin opening 22*a* with these pin receptacle openings. FIG. 4 shows pre-assembled trigger group module 10 positioned above the firearm and trigger group receiving area, while FIG. 5 shows the module and its housing 11 inserted to the operating position with the various openings aligned. It will be noted that inserting trigger group module 10 from the position shown in FIG. 4 to the position shown in FIG. 5 may be accomplished only after removing all of the OEM trigger group components originally in trigger group receiving area 51 and after removing the safety mechanism from its receiving opening 61, to place the firearm frame in the condition shown in FIG. 6. Removing the OEM trigger group components for a firearm such as the illustrated AR-15 rifle is accomplished by removing each OEM trigger group pin to release the respective trigger group component or components supported by the respective pin as is known in the art. It will also be appreciated especially from FIG. 5 that the safety mechanism mounted directly on the firearm frame in openings 61 is in position to cooperate with the back portion of trigger component 15 to provide the desired safety function when the trigger group module 10 is in the operating position.

When module housing 11 is in the operating position shown in FIG. 5, the lowermost part or lower extremity of the module housing is located above the lowermost edge of the receiver side walls which define trigger group receiving area 51. In particular, the lowermost part of module housing 11 is located above the lowermost edge of receiver side wall 53 and is also located above the lowermost edge of opposite receiver side wall 54 (side wall 54 being shown in the top view of FIG. 6). No portion of module housing 11 extends out of the area defined as trigger group receiving area 51. The only portion of trigger group module 10 that is exposed when the module is in the operating position is the pull portion of trigger component 15. Also, no portion of module housing 11 forms any part of the exterior surface of the assembled firearm.

Figure 7:
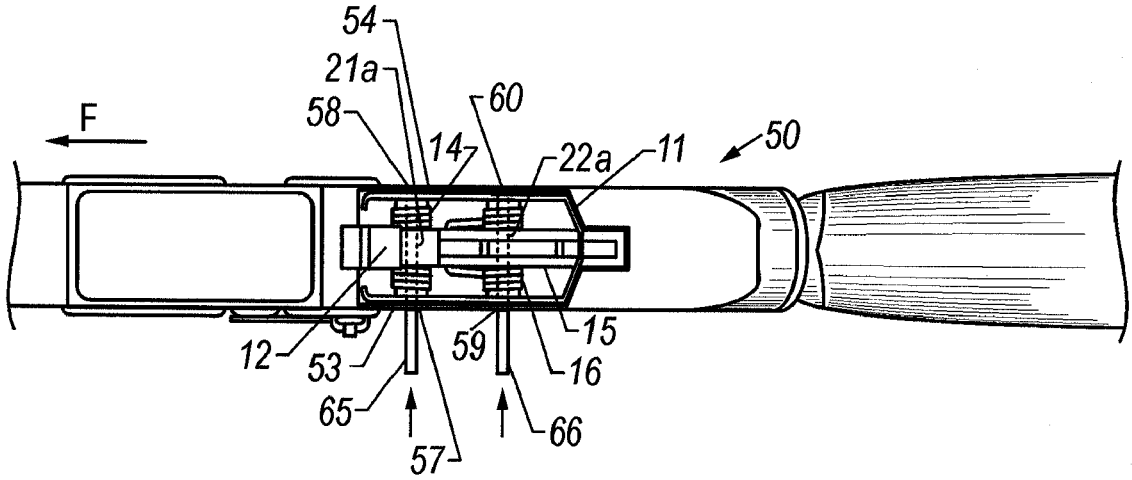
FIG. 7 is a top view of the firearm and trigger group module shown in FIG. 5, with module securing pins partially inserted.

After inserting module 10 to the operating position shown in FIG. 5 with the various pin openings aligned, the method then includes inserting a first retainer pin 65 through one of the first pin receptacle openings and through the corresponding module pin opening. FIG. 7 shows first retainer pin 65 inserted through first right side pin receptacle opening 57, through first right side receiver opening 26 of housing 11, and partially through module pin opening 21*a*.

Figure 8:
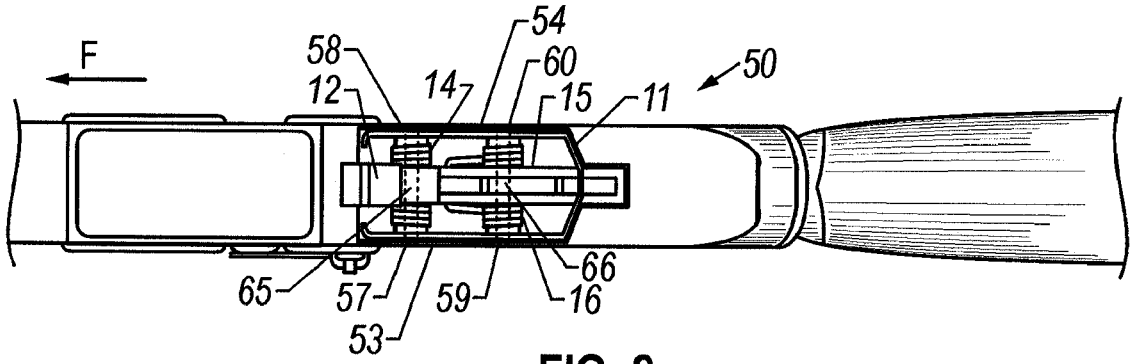
FIG. 8 is a top view similar to FIG. 7 but showing the module securing pins in the fully inserted position.

The trigger group installation method according to the invention finally includes positioning first retainer pin 65 so that the pin is supported at one end by first right side pin receptacle opening 57 and is supported at its opposite end by first left side pin receptacle opening 58 on the opposite side of firearm frame 50. This final position of retainer pin 65 is shown in FIG. 8.

In the embodiment of the invention shown in the figures, trigger group module 10 includes two module pins, first module pin 21 supporting hammer 12 and second module pin 22 supporting trigger component 15. Thus, once openings 29 and 30 making up the second pin receiver are aligned with openings 59 and 60 making up the second pin receptacle, the method includes inserting a second retainer pin 66 through one opening of the pin receptacle and into module pin opening 22*a*. FIG. 7 shows second retainer pin 66 inserted through the right side receptacle opening 59, right side receiver opening 29, and partially through module pin opening 22*a*. Second retainer pin 66 is pushed further through openings 59, 29, and 22*a* until it reaches the position shown in FIG. 8. In this position, second retainer pin 66 is supported on one end by right side pin receptacle opening 59 and is supported at its opposite end by left side pin receptacle opening 60.

In some forms of the invention, module pins 21 and 22 may not align with the OEM pin receptacles of the firearm frame. Because the module pins in the module 10 need not align with the OEM pin receptacles in some forms of the invention, those modules may include a completely different trigger group geometry and structure from the one originally designed for the firearm. Even where the module pins 21 and 22 do not align with the OEM pin receptacles the OEM pin receptacles may still be used in retaining the trigger group module 10 in the operating position in the firearm frame 50. For example, pins, screws, or other elements may be mounted in or through OEM pin receptacles and contact the module 10 or some feature on the module to serve as retaining devices or a retaining arrangement to retain the module in the desired operating position. The OEM pin receptacles may need to be modified to provide the desired function. For example, threads may be tapped into the OEM pin receptacles to accept a retainer or set screw.

It should also be noted that in the model AR-15 rifle example described above, the OEM pin receptacles are designed by the original manufacturer to support trigger group components that are not pre-assembled in a module according to the present invention. However, trigger group modules within the scope of the invention are not limited to use in firearms originally designed to be used with trigger group components assembled in place in the firearm. Rather, trigger group modules within the scope of the present invention may be used with firearms specifically designed to use the trigger group module. An OEM pin receptacle may be a receptacle designed to cooperate with a trigger group module according to the invention.

As used herein, whether in the above description or the following claims, the terms "comprising," "including," "carrying," "having," "containing," "involving," and the like are to be understood to be open-ended, that is, to mean including but not limited to. Only the transitional phrases "consisting of" and "consisting essentially of," respectively, shall be considered exclusionary transitional phrases, as set forth, with respect to claims, in the United States Patent Office Manual of Patent Examining Procedures (Eighth Edition, August 2001 as revised October 2005), Section 2111.03.

Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the following claims.

The invention claimed is:

1. A trigger group module for a firearm, the firearm including a receiver that defines a trigger group receiving area between a first receiver side wall and a second receiver side wall, the trigger group module including:

(a) a module housing adapted to be inserted to an operating position in the trigger group receiving area, the module housing having a lower extremity that is located above a lowermost edge of the first receiver side wall and a lowermost edge of the second receiver side wall when the module housing is in the operating position;

(b) a number of trigger group components mounted within the module housing;

(c) a first pin receiver positioned in the module housing so as to align with first pin receptacle openings of the firearm when the module housing is in the operating position, the first pin receptacle openings defining pin support surfaces formed in the first receiver side wall and the second receiver side wall; and (d) a first module pin mounted in the first pin receiver on which one of the trigger group components is supported in the module housing, the first module pin including an opening that aligns with the first pin receptacle openings of the firearm when the module housing is in the operating position.

2. The trigger group module of claim 1 further including a second pin receiver positioned in the module housing so as to align with second pin receptacle openings of the firearm when the module housing is in the operating position, the second pin receptacle openings defining pin support surfaces formed in the first receiver side wall and the second receiver side wall.

3. The trigger group module of claim 2 further including a second module pin mounted in the second pin receiver on which an additional one of the trigger group components is supported in the trigger group housing, the second module pin including an opening that aligns with the second pin receptacle openings of the firearm when the module housing is in the operating position.

4. The trigger group module of claim 1 wherein the receiver includes a safety mechanism mounted directly thereon and wherein the safety mechanism contacts one of the trigger group components when the trigger group module is in the operating position and the safety mechanism is in an engaged position.

5. A firearm including:

(a) a receiver having a first receiver side wall and a second receiver side wall that define a trigger group receiving area there between;

(b) first pin receptacle openings formed in the first receiver side wall and the second receiver side wall and defining first pin support surfaces;

(c) a module housing located in an operating position in the trigger group receiving area, the module housing in the operating position having a lower extremity that is located above a lowermost edge of the first receiver side wall and a lowermost edge of the second receiver side wall;

(d) a number of trigger group components mounted within the module housing; and (e) a first pin receiver positioned in the module housing and aligning with the first pin receptacle openings; and a first module pin mounted in the first pin receiver and wherein one of the trigger group components is supported in the module housing on the first module pin, the first module pin including an opening that aligns with the first pin receptacle openings.

6. The firearm of claim 5 further including:

(a) second pin receptacle openings formed in the first receiver side wall and the second receiver side wall and defining pin support surfaces; and (b) a second pin receiver in the module housing, the second pin receiver aligning with the second pin receptacle openings of the firearm.

7. The firearm of claim 6 further including a second module pin mounted in the second pin receiver, and wherein an additional one of the trigger group components is supported in the trigger group housing on the second module pin, the second module pin including an opening that aligns with the second pin receptacle openings of the firearm.

8. The firearm of claim 5 further including a safety mechanism mounted directly on the receiver and wherein the safety mechanism in an engaged position contacts one of the trigger group components.

9. The firearm of claim 5 wherein the receiver represents a lower receiver of the firearm and wherein the lower receiver is connected to an upper receiver.

10. A trigger group module for a firearm, the trigger group module including:

(a) a module housing adapted to be inserted to an operating position in a firearm, the firearm including a receiver that defines a trigger group receiving area between a first receiver side wall and a second receiver side wall and the firearm further including a safety mechanism mounted directly on the receiver;

(b) a first trigger group component mounted on the module housing and adapted to cooperate with the safety mechanism when the module housing is in the operating position in the firearm and when the safety mechanism is in an engaged position;

(c) a first pin receiver positioned in the module housing;

(d) a second pin receiver positioned in the module housing;

(e) a first module pin mounted in the first pin receiver, the first module pin including an opening that aligns with first pin receptacle openings of the firearm when the module housing is in the operating position; and (f) a second module pin mounted in the second pin receiver, the second module pin including an opening that aligns with second pin receptacle openings of the firearm when the module housing is in the operating position.

* * * * *

UNITED STATES PATENT AND TRADEMARK OFFICE

CERTIFICATE OF CORRECTION

PATENT NO. : 7,293,385 C1
APPLICATION NO. : 90/013200
DATED : August 20, 2014
INVENTOR(S) : Michael L. McCormick It is certified that error appears in the above-identified patent and that said Letters Patent is hereby corrected as shown below:

Title Page, Item (73) Assignee: delete "Sovereign Bank, N. A., Hartford, CT (US)" and insert --O.F. Mossberg & Sons, Inc., North Haven, CT (US)--.

Signed and Sealed this
Sixteenth Day of September, 2014

Michelle K. Lee

Michelle K. Lee
*Deputy Director of the United States Patent and Trademark Office*

US007293385C1

(12) EX PARTE REEXAMINATION CERTIFICATE (10264th)

United States Patent
McCormick

(10) Number: US 7,293,385 C1
(45) Certificate Issued: Aug. 20, 2014

(54) MODULAR TRIGGER GROUP FOR FIREARMS AND FIREARM HAVING A MODULAR TRIGGER GROUP

(75) Inventor: Michael L. McCormick, Austin, TX (US)

(73) Assignee: Sovereign Bank, N.A., Hartford, CT (US)

Reexamination Request:
No. 90/013,200, Apr. 21, 2014

Reexamination Certificate for:

| | |
|---|---|
| Patent No.: | **7,293,385** |
| Issued: | **Nov. 13, 2007** |
| Appl. No.: | **11/621,485** |
| Filed: | **Jan. 9, 2007** |

Related U.S. Application Data

(60) Division of application No. 10/806,300, filed on Mar. 22, 2004, now Pat. No. 7,162,824, which is a continuation of application No. 10/152,557, filed on May 21, 2002, now Pat. No. 6,772,072.

(51) Int. Cl.
*F41A 11/00* (2006.01)

(52) U.S. Cl.
USPC ..... 42/75.03; 124/31; 124/32; 42/41; 42/42.02; 42/42.03; 42/69.03; 89/128; 89/138; 89/155; 89/27.11

(58) Field of Classification Search
None
See application file for complete search history.

(56) References Cited

To view the complete listing of prior art documents cited during the proceeding for Reexamination Control Number 90/013,200, please refer to the USPTO's public Patent Application Information Retrieval (PAIR) system under the Display References tab.

*Primary Examiner* — William Doerrler

(57) ABSTRACT

A module housing is adapted to be inserted into an operating position in the trigger group receiving area of a firearm. The module housing includes at least one pin receiver defined by two openings formed in the module housing, one on each lateral side of the housing. A module pin is received in the pin receiver and at least one trigger group component is mounted or supported for rotation on the module pin. The pin receiver is located on the module housing so as to align with a pin receptacle of the firearm when the module housing is in the operating position. By locating the pin receiver in the module housing so as to align with a corresponding pin receptacle of the firearm when the module housing is in the operating position, the trigger group module and the trigger group components housed in the module housing may be readily supported by the OEM pin receptacle. The trigger group module, pre-assembled with one or more trigger group components, may be inserted to the operating position and then held in place using the OEM pin receptacle.

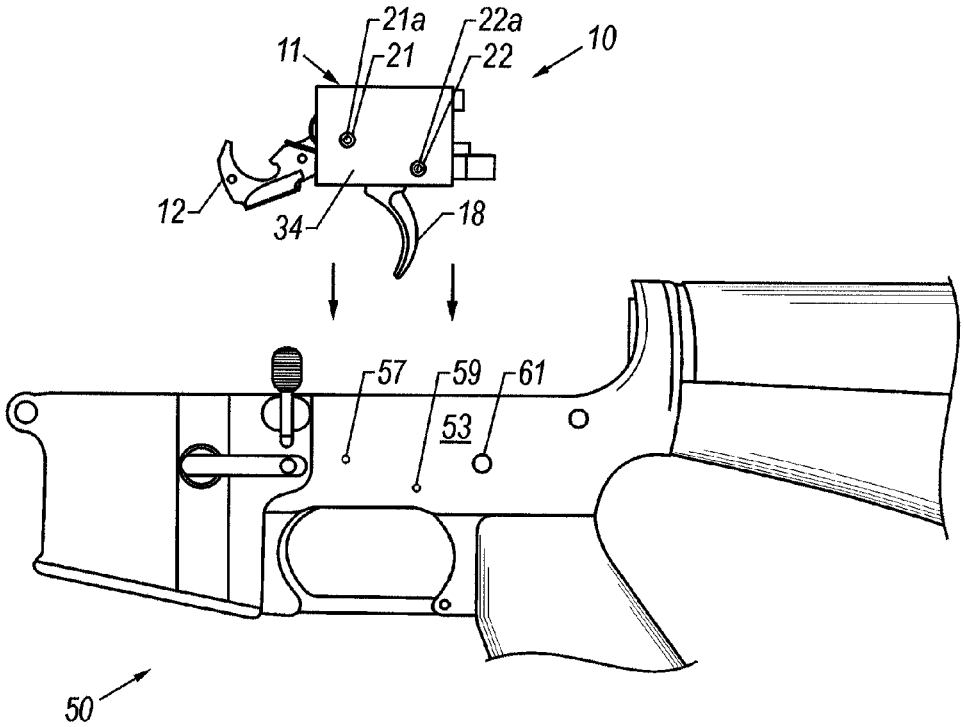

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, lines 13-26:

[Housing] *Module housing* 11 includes a first pin receiver for receiving first module pin 21 and supporting the first module pin by its *two* ends. This first pin receiver is made up of a first right side receiver opening 26 on a right lateral side or first *module* side wall 31 of housing 11 and a first left side receiver opening 27 on the opposite lateral side or second *module* side wall 32 of the housing. Similarly, housing 11 includes a second pin receiver for receiving second module pin 22 and supporting the second module pin by its *two* ends. This second pin receiver is made up of a second right side receiver opening 29 and a second left side receiver opening 30. Module pins 21 and 22 may be held in place in module housing 11 by frictional engagement with the receiver openings, by "C" retainers, or by any other suitable means.

Figure 2:
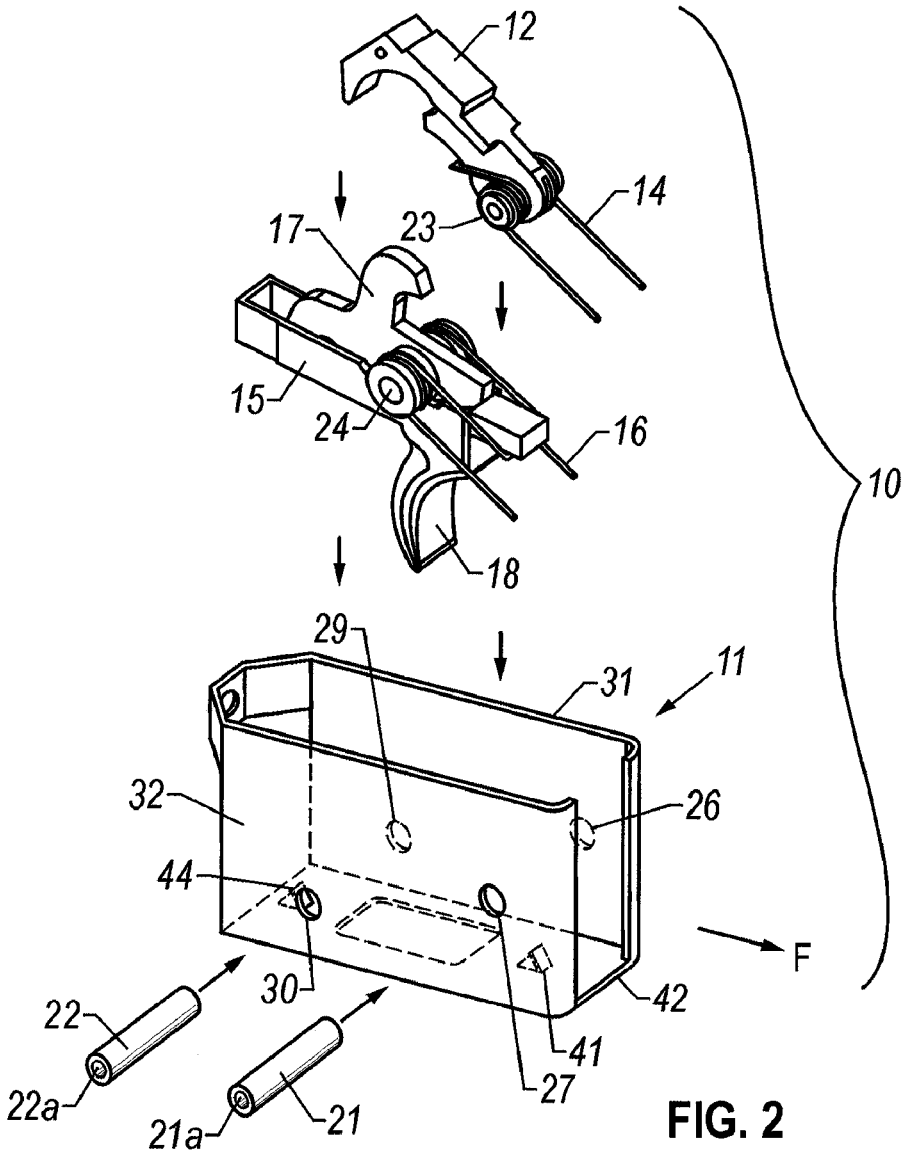
FIG. 2 is an exploded view in perspective of the trigger group module shown in FIGS. 1A and 1B.

Column 5, between lines 26 and 27:

*As best shown in FIG. 2, the first module side wall 31 and the second module side wall 32 are spaced apart from one another. As best shown in FIGS. 2, 3, 8, trigger group components (i.e., a hammer and a trigger) are mounted on the two module pins 21, 22 for rotation on the pins between the first module wall 31 and the second module wall 32.*

AS A RESULT OF REEXAMINATION, IT HAS BEEN DETERMINED THAT:

The patentability of claims 1-9 is confirmed.

Claim 10 is cancelled.

New claims 11-15 are added and determined to be patentable.

*11. A trigger group module for a firearm, the trigger group module comprising:*

*a. a trigger group module housing adapted to be inserted to an operating position, within a trigger group receiving area, between a first receiver side wall and a second receiver side wall of a receiver of the firearm, with a lower extremity of the module housing located above a lowermost edge of the first receiver side wall and a lowermost edge of the second receiver side wall;*

*b. the module housing has a first module side wall and a second module side wall spaced apart from the first module side wall;*

*c. the first module wall contains a first pin receiver opening and a second pin receiver opening;*

*d. the second module wall contains a first pin receiver opening and a second pin receiver opening;*

*e. a first module pin has two ends respectively mounted in the first pin receiver opening of the first module wall and in the first pin receiver opening of the second module wall, whereby:*

*i. the first module pin is supported by, and extends between, the first module side wall and the second module side wall;*

*f. a hammer mounted, between the first module side wall and the second module side wall, on the first module pin for rotation on the first module pin, wherein:*

*i. the first module pin has a pin opening, extending through the first module pin, aligned with the first pin receiver opening of the first module wall and the first pin receiver opening of the second module wall;*

*g. a second module pin has two ends respectively mounted in the second pin receiver opening of the first module wall and in the second pin receiver opening of the second module wall, whereby:*

*i. the second module pin is supported by, and extends between, the first module side wall and the second module side wall;*

*h. a trigger mounted, between the first module side wall and the second module side wall, on the second module pin for rotation on the second module pin, wherein:*

*i. the trigger is adapted to cooperate with a safety mechanism, mounted directly on a receiver of the firearm, when the module housing is in the operating position in the rifle and when the safety mechanism is in an engaged position;*

*ii. the second module pin has a pin opening, extending through the second module pin, aligned with the second receiver opening of the first module wall and the second receiver opening of the second module wall;*

*iii. wherein the pin opening of the first module pin is adapted to align with a first pin receptacle opening in the first receiver side wall and a first pin receptacle opening in the second receiver side wall, when the module housing is in the operating position; and*

*iv. wherein the pin opening of the second module pin is adapted to align with a second pin receptacle opening in the first receiver side wall and a second pin receptacle opening in the second receiver side wall, when the module housing is in the operating position.*

*12. A trigger group module for a firearm, the firearm including a receiver that defines a trigger group receiving area between a first receiver side wall and a second receiver side wall, the trigger group module including:*

*a. a module housing adapted to be inserted to an operating position in the trigger group receiving area, the module housing having a lower extremity that is located above a lowermost edge of the first receiver side wall and a lowermost edge of the second receiver side wall when the module housing is in the operating position;*

*b. the module housing has a first module side wall spaced apart from a second module side wall;*

*c. a number of trigger group components mounted within the module housing between the first module wall and the second module wall;*

*d. a first pin receiver, defined by a hole in the first module side wall and a hole in the second module side wall of the module housing, positioned in the housing so as to align with first pin receptacle openings of the firearm when the module housing is in the operating position, the first pin receptacle openings defining pin support surfaces formed in the first receiver side wall and the second receiver side wall;*

*e. a first module pin, with a pin opening extending through the first module pin, mounted in the first pin receiver, wherein the first module pin extends between the first module wall and the second module wall, one of the trigger group components is supported on the first module pin for rotation on the first module pin between the first module wall and the second module wall in the module housing, the first module pin including an opening that aligns with the first pin receptacle openings of the firearm when the module housing is in the operating position;*

*f. a second pin receiver, defined by another hole in the first module side wall and another hole in the second module side wall of the module housing, positioned in the module housing so as to align with second pin receptacle openings of the firearm when the module housing is in the operating position, the second pin receptacle openings defining pin support surfaces formed in the first receiver side wall and the second receiver side wall;*

*g. a second module pin, with a pin opening extending through the second module pin, mounted in the second pin receiver, wherein the second module pin extends between the first module wall and the second module wall, an additional one of the trigger group components is supported on the second module pin for rotation on the second module pin between the first module wall and the second module wall in the trigger group module housing, the pin opening of the second module pin aligns with the second pin receptacle openings of the firearm when the module housing is in the operating position;*

*h. a first retainer pin extends through the first pin receptacle openings, through the first pin receiver, and through the pin opening of the first module pin; and*

*i. a second retainer pin extends through the second pin receptacle openings, through the second pin receiver, and though the pin opening of the second module pin.*

*13. The trigger group module of claim 12 wherein the firearm is an AR-15 rifle.*

*14. The trigger group module of claim 12 wherein the firearm is a semi-automatic rifle.*

*15. In an AR-15 rifle of the type having a receiver with first pin receptacle openings and second pin receptacle openings in two side walls of a rifle frame, retainer pins removably inserted into the pin receptacle openings, and a safety mechanism mounted on the rifle frame to engage a trigger group component, the improvement comprising:*

*a. a trigger group module comprising:*

*i. a module housing adapted to fit in an operating position within a receiver of the AR-15 rifle between the side walls of the rifle frame, with a lower extremity of the module housing located above a lowermost edge of the first receiver side wall and a lowermost edge of the second receiver side wall;*

*ii. the module housing has a first module side wall and a second module side wall spaced apart from the first module side wall;*

*iii. the first module wall contains a first pin receiver opening;*

*iv. the second module wall contains a first pin receiver opening;*

*v. a first module pin mounted in the module housing and extending between the first module side wall and the second module side wall, wherein:*

*1. the first module pin has two ends located respectively within the first pin receiver opening of the first module wall and the first pin receiver opening of the second module wall;*

*vi. a hammer mounted, between the first module side wall and the second module side wall, on the first module pin for rotation on the first module pin;*

*1. wherein the first module pin has a pin opening, extending through the first module pin, aligned with the first pin receiver opening of the first module wall, the first pin receiver opening of the second module wall, and the first pin receptacle openings in the side walls of the rifle frame; and*

*2. wherein the first retainer pin has been inserted into the first receiver opening of the first module wall, the pin opening of the first module pin, the first receiver opening of the second module wall, and the first pin receptacle openings.*

*vii. the first module wall contains a second pin receiver opening;*

*viii. the second module wall contains a second pin receiver opening;*

*ix. a second module pin mounted in the module housing and extending between the first module side wall and the second module side wall, wherein:*

*1. the second module pin has two ends located respectively within the second pin receiver opening of the first module wall and the second pin receiver opening of the second module wall;*

*x. a trigger mounted, between the first module side wall and the second module side wall, on the second module pin for rotation on the second module pin;*

*1. wherein the second module pin has a pin opening, extending through the second module pin, aligned with the second pin receiver opening of the first module wall, the second pin receiver opening of the second module wall, and the second pin receptacle openings in the side walls of the rifle frame; and*

*2. wherein the second retainer pin has been inserted into the second pin receiver opening of the first module wall, the pin opening of the second module pin, the second pin receiver opening of the second module wall, and the second pin receptacle openings.*

* * * * *